US010639666B2

(12) United States Patent
Kim et al.

(10) Patent No.: US 10,639,666 B2
(45) Date of Patent: May 5, 2020

(54) SUPERPARTICLE ATOMIZING DEVICE

(71) Applicants: SEOUL NATIONAL UNIVERSITY R&DB FOUNDATION, Seoul (KR); PURETECK CO., LTD., Seoul (KR)

(72) Inventors: Jeong Woo Kim, Seoul (KR); Jeong Yang Kim, Seoul (KR); Yun Jaie Choi, Gyeonggi-do (KR)

(73) Assignees: SEOUL NATIONAL UNIVERSITY R&DB FOUNDATION, Seoul (KR); PURETECK CO., LTD., Seoul (KR)

( * ) Notice: Subject to any disclaimer, the term of this patent is extended or adjusted under 35 U.S.C. 154(b) by 241 days.

(21) Appl. No.: 15/571,768

(22) PCT Filed: Mar. 7, 2016

(86) PCT No.: PCT/KR2016/002246
§ 371 (c)(1),
(2) Date: Nov. 3, 2017

(87) PCT Pub. No.: WO2016/190527
PCT Pub. Date: Dec. 1, 2016

(65) Prior Publication Data

US 2018/0147594 A1 May 31, 2018

(30) Foreign Application Priority Data

May 28, 2015 (KR) ..... 10-2015-0074803

(51) Int. Cl.
*B05B 17/06* (2006.01)
*B05B 7/00* (2006.01)
(Continued)

(52) U.S. Cl.
CPC ..... *B05B 17/0607* (2013.01); *B05B 1/02* (2013.01); *B05B 7/0012* (2013.01);
(Continued)

(58) Field of Classification Search
CPC ..... B05B 1/02; B05B 17/0607; B05B 7/0012; B05B 17/0615; B05B 17/0676; F24F 6/12;
(Continued)

(56) References Cited

U.S. PATENT DOCUMENTS 4,986,937 A * 1/1991 Sorio ..... F24F 6/12 126/113
5,464,572 A * 11/1995 Bonzi ..... B05B 17/0615 250/324
(Continued)

FOREIGN PATENT DOCUMENTS

JP 2004-216221 8/2004
JP 2013-099472 5/2013
(Continued)

OTHER PUBLICATIONS

International Search Report dated Jun. 10, 2016 for PCT/KR2016/002246.

*Primary Examiner* — Charles S Bushey

(57) ABSTRACT

The present invention relates to a superparticle atomizing device and, more specifically, to a superparticle atomizing device having an inner plate provided at the upper part of an ultrasonic vibrator inside a housing and having a circulation passage formed at the circumference of the inner plate of the inside of the housing by using the rapid flow rate of the air to be ventilated to the inside of the housing through a blower, and thus only liquid microparticles generated at the lower region of the inner plate by the ultrasonic vibrator are pulled up to the upper region thereof, thereby allowing the liquid microparticles to be atomized through an atomizing hole and allowing the liquid microparticles to be rapidly diffused into the air with rapid ventilation air.

11 Claims, 3 Drawing Sheets

(51) Int. Cl.

| | |
|---|---|
| ***B05B 1/02*** | (2006.01) |
| ***F24F 6/12*** | (2006.01) |
| *F24F 11/00* | (2018.01) |
| *F24F 6/00* | (2006.01) |
| *F24F 13/08* | (2006.01) |
| *F24F 13/20* | (2006.01) |

(52) U.S. Cl.
CPC ..... *B05B 17/0615* (2013.01); *B05B 17/0676* (2013.01); *F24F 6/12* (2013.01); *F24F 11/0008* (2013.01); *F24F 13/08* (2013.01); *F24F 13/20* (2013.01); *F24F 2006/008* (2013.01); *F24F 2013/205* (2013.01)

(58) Field of Classification Search
CPC ..... F24F 13/08; F24F 13/20; F24F 2013/205; F24F 11/0008; F24F 2006/008
USPC ..... 261/78.2, 81
See application file for complete search history.

(56) References Cited

U.S. PATENT DOCUMENTS 5,624,608 A * 4/1997 Ching ..... B05B 17/0607 239/102.2
5,645,769 A * 7/1997 Tamaru ..... B01F 3/04007 261/30
5,653,919 A * 8/1997 White ..... B01F 3/04021 261/21
5,702,648 A * 12/1997 White ..... B01F 3/022 261/142
6,755,398 B1 * 6/2004 Wong ..... A61H 33/063 261/127
7,350,773 B2 * 4/2008 French ..... F24F 6/02 261/79.2
7,686,285 B2 * 3/2010 Murray ..... B05B 17/0615 261/81
7,810,742 B2 * 10/2010 Levi ..... A01M 1/205 239/102.1
7,934,703 B2 * 5/2011 Tomono ..... A01M 1/205 261/18.1
8,128,069 B2 * 3/2012 Reens ..... F24F 6/12 261/116
9,316,405 B2 * 4/2016 Moon ..... F24F 3/14

FOREIGN PATENT DOCUMENTS

| | | |
|---|---|---|
| KR | 10-0513693 | 9/2005 |
| KR | 10-2006-0041074 | 5/2006 |
| KR | 10-0577241 | 5/2006 |
| KR | 20-2010-0011542 | 11/2010 |

* cited by examiner

SUPERPARTICLE ATOMIZING DEVICE

This application claims the priority of Korean Patent Application No. 10-2015-0074803, filed on May 28, 2015 in the KIPO (Korean Intellectual Property Office), the disclosure of which is incorporated herein entirely by reference. Further, this application is the National Stage application of International Application No. PCT/KR2016/002246, filed Mar. 7, 2016, which designates the United States and was published in Korean. Each of these applications is hereby incorporated by reference in their entirety into the present application.

TECHNICAL FIELD

The present invention relates to a super-particle spraying apparatus, and more particularly, to a super-particle spraying apparatus in which an inner plate is provided on an upper side of an ultrasonic vibrator inside a housing, and a circulation passage is formed around the inner plate inside the housing by using fast stream velocity of air being blown into the housing through a blower, and a spray nozzle atomizing fine liquid particles which circulates from a lower area of the inner plate outside the housing through the circulation passage.

BACKGROUND ART

In general, a spraying apparatus using an ultrasonic vibrator is a device for spraying fine particles of water by ultrasonically vibrating the water, and has been mainly used for adjusting the humidity to keep the indoor condition pleasant by providing moisture in a dry place.

As an example of the above-described spraying apparatus, Korean Patent Registration No. 10-0577241 briefly describes a spraying unit comprising an ultrasonic vibrator and a blowing fan, and a water tank for supplying water to the ultrasonic vibrator side of the spraying unit.

Therefore, fine liquid particles are generated by the vibration of the ultrasonic vibrator. When the air is blown by the blowing fan, the fine liquid particles are sprayed to the outside together with the blowing air through the nozzle of the spraying part.

However, in the conventional spraying apparatus using the ultrasonic vibrator, liquid particles generated upon vibration of the ultrasonic vibrator comprise not only fine liquid particles but also larger liquid particles and even water droplets. In this case, the air flow rate (output) of the air blowing fan is decreased, the fine liquid particles are sprayed but the diffusion speed is decreased. However, when the air flow rate (output) of the air blowing fan is increased, the diffusion speed is accelerated, but, there is a problem that the periphery of the spraying device is wet because of spraying the water droplet.

In addition, since the region where fine liquid particles less affected by the air blown from the blowing fan is existed, the spraying efficiency is lowered because it is not sprayed smoothly.

DISCLOSURE OF THE INVENTION

Technical Problem

Due to the above problems, the spraying device using the ultrasonic vibrator could not be used as a sterilizer, but was used only as a humidifier.

Accordingly, it is an object of the present invention to maximize the fine particle generating capability of an atomizing apparatus using an ultrasonic vibrator, to increase the spraying efficiency and to increase the spraying speed without increasing large liquid particles even if the air flow rate (output) is increased.

To this end, an inner plate is provided on the upper side of the ultrasonic vibrator inside the housing, and a circulation passage is formed around the inner plate inside the housing by using a high velocity of the air blown into the housing through the blower, so that a spray nozzle atomizes only fine liquid particles which circulates from a lower area of the inner plate outside the housing through the circulation passage.

Technical Solution

According to an aspect of the present invention, there is provided an apparatus for super particle spraying comprising in which an inner plate is provided on an upper side of an ultrasonic vibrator inside a housing, and a circulation passage is formed around the inner plate inside the housing by using fast stream velocity of air being blown into the housing through a blower, and a spray nozzle atomizing fine liquid particles which circulates from a lower area of the inner plate outside the housing through the circulation passage.

Advantageous Effects

According to an embodiment of the present invention, there is provided an inner plate on an upper side of an ultrasonic vibrator inside a housing, and a circulation passage formed around the inner plate inside the housing by using fast stream velocity of air being blown into the housing through a blower, so as to atomize atomizing fine liquid particles which circulates from a lower area of the inner plate outside the housing through the circulation passage by a spray nozzle. Therefore, the present invention provides to improve the spraying capability as atomizing only the fine liquid particles generated in the lower area of the inner plate by the ultrasonic vibrator, as well as to use as the sterilizer or humidifier since the fine liquid particles and the fast blowing air are spread into the air.

In addition, since the inner plate protrudes from the liquid during the vibration of the ultrasonic vibrator, the spraying speed can be further increased without causing large liquid particles (water droplets) to follow even if the blowing air volume (output) is increased.

MODE FOR CARRYING OUT THE INVENTION

Figure 1:
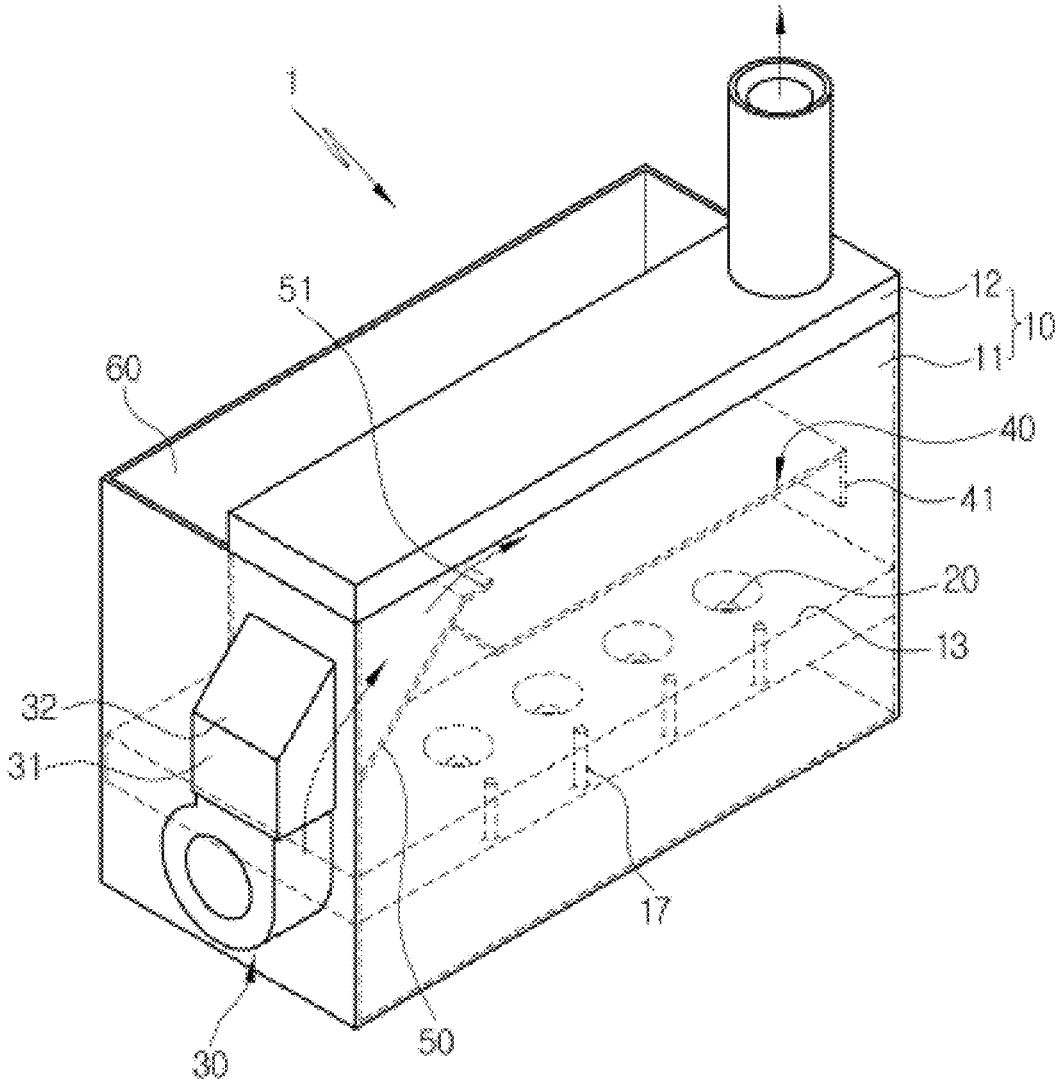
FIG. 1 is a perspective view showing a super-particle spraying apparatus according to the present invention.

Hereinafter, the present invention will be described in detail with reference to the accompanying drawings.

The super particle spraying apparatus 1 according to the present invention comprises a housing 10, an ultrasonic vibrator 20, a blower 30, an inner plate 40, and a spray nozzle 16.

The housing 10 comprises a body 11 in which a liquid is accommodated and an upper portion is opened and a lid 12 which is detachably coupled to an upper portion of the body 11 to close an opened upper portion of the body 11.

Since the liquid can use various liquids such as water or a liquid medicine, it can be used as a humidifier, a sterilizer, a sterilizer, and the like.

An air inlet 15 is formed at one side of the housing 10.

The air inlet 15 is formed on one side of the housing 10 facing the one longitudinal end portion of the inner plate 40 to be described later.

The housing 10 is provided with the fluid dispenser 16 so that fine liquid particles (5 μm or less) circulating from the lower region to the upper region of the inner plate 40 through the circulation passage 17 are supplied to the outside of the housing 10.

At that time, the fluid dispenser 16 is formed on the upper side of the housing 10 opposite to the air inlet 15, that is, on the upper surface of the lid 12.

On the other hand, the liquid is filled up to a predetermined level from the bottom plate 13 in the housing 10, and the liquid level is maintained at a constant level by the water level detecting means not shown.

The ultrasonic transducer 20 is installed in the housing 10 and vibrates the liquid to generate fine liquid particles.

A plurality of ultrasonic transducers 20 are installed in a row on the bottom plate 13 of the housing 10 at a predetermined distance from each other. That is, four ultrasonic transducers 20 are arranged in accordance with a standard spray amount (1000 cc/h). That is, 200~300 cc/h per each transducer.

At that time, the bottom plate 13 of the housing 10 is provided with a plurality of mounting grooves 13*a* spaced apart from each other by a predetermined distance, and the ultrasonic transducer 20 is inserted into the mounting groove 13*a*.

The ultrasonic transducer 20 is installed on the lower side of the installation groove 13*a*.

In addition, the upper portion of the installation groove 13*a* is formed as an expanded portion 13*b* that is gradually expanded toward the upper side. Therefore, even if the liquid level in the housing 10 gradually decreases, the liquid can be collected into the expanded portion 13*b*, so that the remaining liquid can be sprayed.

The ultrasonic transducer 20 is preferably Teflon coated to prevent corrosion.

The blower 30 blows air into the housing 10 through the air inlet 15.

The blower 30 is installed on the outer surface of the housing 10 in which the air inlet 15 is located.

The outer surface of the housing 10 is provided with a blowing duct 31 for guiding the air blown from the blower 30 to the air inlet 15.

At that time, an inclined portion 32 is formed on the upper side of the blowing duct 31 to guide the air blown from the blower 30 to the upper side of the inside of the housing 10.

The inner plate 40 is installed at a predetermined distance from the inside of the housing 10 to the upper side of the ultrasonic transducer 20 and the circulation passage 17 is formed to circulate the fine liquid particles by using stream velocity of air blown into the inside of the housing 10.

The inner plate 40 is installed horizontally at a position 7 to 8 cm above the ultrasonic transducer 20. That is, when the ultrasonic vibrator 20 vibrates, the height of the liquid is reduced so that the liquid is sufficiently fractionated so that the amount of the fine liquid particles sprayed is maximized.

Figure 2:
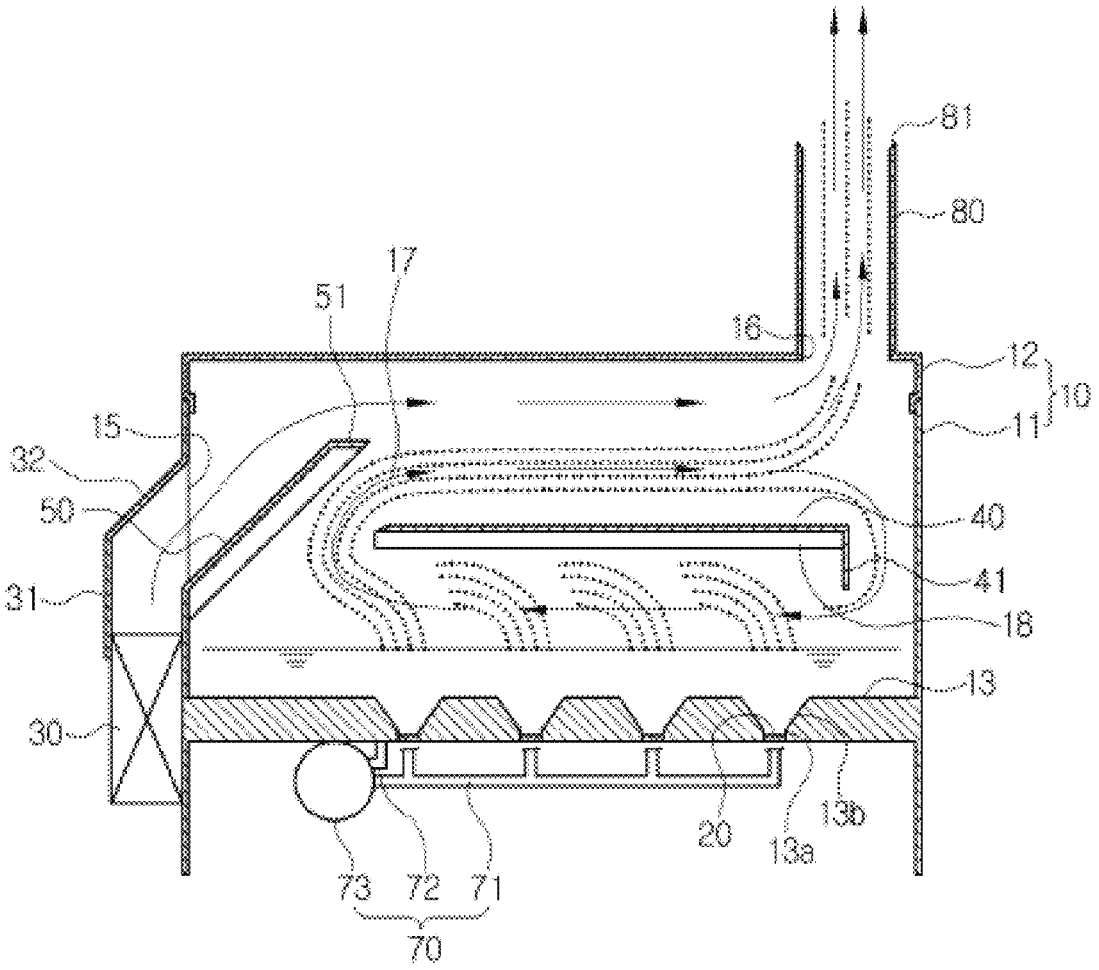
FIG. 2 is a sectional view showing the inside of a housing in a super-particle spraying apparatus according to the present invention.
Figure 3:
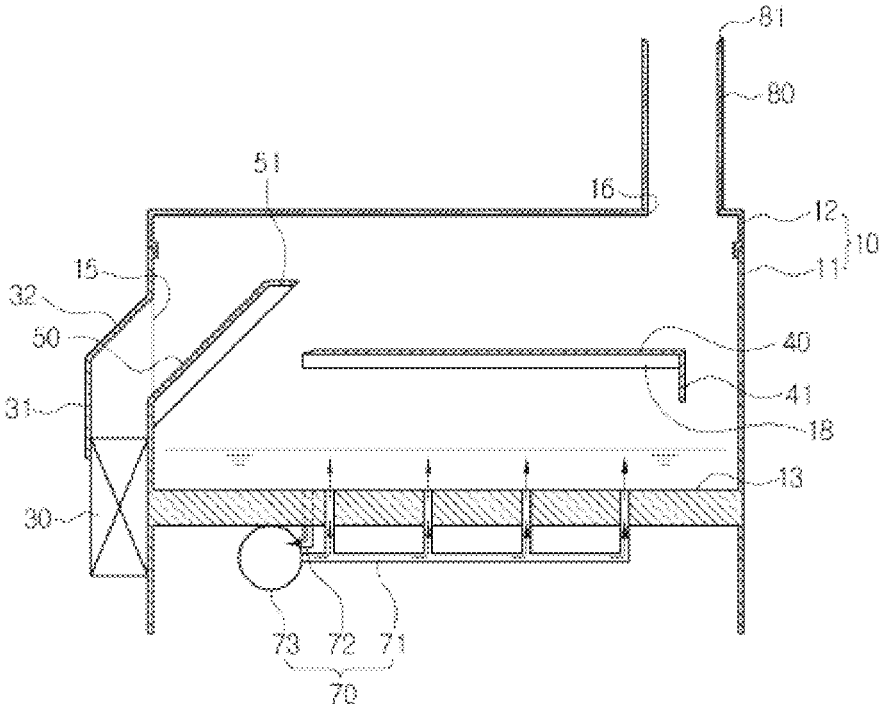
FIG. 3 is a cross-sectional view showing a state in which a liquid supply device supplies liquid into the interior of the housing in the super-particle spraying apparatus according to the present invention.

As stated as FIG. 2, the inner plate 40 is spaced apart from the upper, lower, left, and right inner sides of the housing 10 by a predetermined distance, and in the separated room formed by the inner plate 40 and the hosing 10, a circulation passage 17 is formed to circulate the air and the fine liquid particles around the inner plate 40.

A guide plate 50 is provided between the air inlet 15 and the inner plate 40 to guide the air introduced into the air inlet 15 to the upper side of the circulation passage 17.

The guide plate 50 is slanted between the air inlet 15 and the inner plate 40 so that a venturi effect is generated again the circulation passage 17 between the inner plate 40 and the guide plate 50 by using air stream velocity blown into the hosing 10 through the blower 30.

That is, the guide plate 50 is installed at an angle of 45° to rapidly induce the flow velocity of air blown into the housing 10 through the blower 30, and at the upper end of the guide plate 50 the air stream velocity is fasten rapidly so that the negative pressure (Venturi effect) is generated in the lower region of the inner plate 40. As a result, only fine liquid particles (light particles) of various sizes generated in the lower region of the inner plate 40 are sucked up and is sprayed to the outside through the spray nozzle 16 on the upper side of the housing 10 together with the blown air.

The guide plate 50 divides the air inlet 15 and the circulation passage 17 so that the air introduced through the air inlet 15 is guided along the guide plate 50 to the circulation passage 17.

At this time, a venturi effect occurs in the circulation passage 17 between the guide plate 50 and the inner plate 40 due to the air flow velocity above the guide plate 50, so that a circulation flow of the air along the circulation passage 17 is generated as shown FIG. 2.

In addition, when fine liquid particles are generated due to the vibration of the ultrasonic vibrator 20, the fine liquid particles are circulated along the circulating air flowing through the circulation passage 17 as shown in FIG. 2. The fine liquid particles circulating through the circulation passage 17 are sprayed to the outside through the spray port 16.

The inner plate 40 is installed in the housing 10 to form the circulation passage 17 along the periphery of the inner plate 40 so that the air circulating in the circulation passage 17 flows through the inner plate 40, only the fine liquid particles generated in the lower region of the inner plate 40 are lifted up to the upper region of the inner plate 40 and are sprayed to the outside through the spray nozzle 16 so that the spraying efficiency can be enhanced and the fine liquid particles are also quickly diffused into the air, which can be used as a sterilizer as well as a humidifier.

The lower end of the guide plate 50 is connected to the lower end of the air inlet 15 and the upper end of the guide plate 50 is formed at predetermined distance upward from the one end of the inner plate 40.

In addition, an extension 51 parallel to the inner plate 40 is formed at the upper end of the guide plate 50. The extension portion 51 minimizes the collision between the air flowing through the air inlet 15 and the upper portion of the guide plate 50 and the air circulating through the circulation passage 17.

The extended portion 51 of the guide plate 50 is formed at a position where the upper region of the inner plate 40 inside the housing 10 is divided into two parts.

The inner plate 40 is installed parallel to the bottom plate 13 of the housing 10 and has a length greater than a length connected to the centers of the two ultrasonic transducers 20 at both ends of the plurality of ultrasonic transducers 20.

As shown as FIG. 2, the length of the inner plate 40 is greater than the length connected to the centers of the two ultrasonic transducers 20 at both ends of the plurality of ultrasonic transducers 20.

In other words, the inner plate 40 is positioned so as to be positioned at a vertical position of the plurality of ultrasonic transducers 20, and the inner plate 40 is formed to have a size enough to cover all of the plurality of ultrasonic transducers 20.

Therefore, even when the airflow volume (output) is increased, large liquid particles (water droplets) do not come out and the spray diffusion velocity is more increased by preventing water droplets bounded the liquid generated by vibration of the ultrasonic vibrator 20 with the inner plate 40.

In addition, even if the air volume (output) of the blower 30 is increased, the problem of wetting the periphery of the atomizing device can be prevented because the water droplets are not discharged to the outside.

In addition, the end plate of the inner plate 40 is provided with a shutoff plate 41 for controlling the cross-sectional area of the circulation passage 17 and preventing diffusion of water droplets protruding from the liquid.

The blocking plate 41 is formed to have a predetermined length downward from the end of the inner plate 40 near the dispenser 16 to prevent the water droplets from being discharged to the dispenser 16 and to adjust the circulation passage 17.

Figure 4:
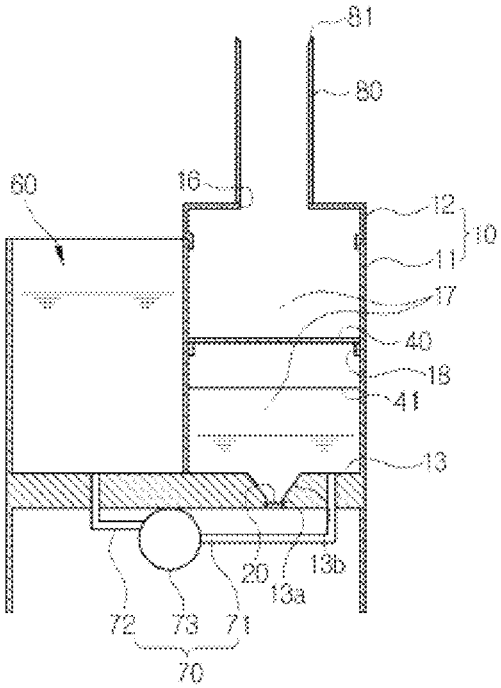
FIG. 4 is a side sectional view showing a housing and a liquid reservoir in a super-particle spraying apparatus according to the present invention.

As shown as FIG. 4, a supporting portion 18 for supporting the inner plate 40 is formed on opposite sides of the inner side of the housing 10 where the inner plate 40 is located, and the inner plate 40 is seated on the support portion 18.

The discharge port 16 is provided with a discharge duct 80 having a predetermined height.

At this time, an inclined surface portion 81 inclined downward from the edge is formed on the upper end of the discharge duct 80.

That is, water droplets are formed on the inner and upper surfaces of the discharge duct 80 by the fine liquid particles sprayed through the discharge duct 80. At this time, water droplets formed on the upper surface of the discharge duct 80. The water droplets are prevented from being discharged to the outside by flowing into the housing 10 through the inclined surface portion 81 again.

In order to increase the spray efficiency of the fine liquid particles, the cross-sectional area of the air inlet 15 and the cross-sectional area of the atomizer 16 are preferably the same, but may be changed.

A liquid reservoir 60 for storing liquid to be supplied to the inside of the housing (10) is provided at one side of the housing 10.

Although the liquid reservoir 60 is integrally formed on one side of the housing 10 at FIGs, the liquid reservoir 60 may be detachably attached to the housing 10.

A liquid supply device 70 for supplying the liquid in the liquid reservoir 60 to the inside of the housing 10 is provided on the lower side of the housing 10.

The liquid supply device 70 includes a first hose 71 connected to the inside of the housing 10 and a second hose 72 connected to the inside of the liquid storage 60 to communicate with the inside of the housing 10, and a water pump 73 connected to the first hose 71 and the second hose 72.

The first hose 71 connected to the housing 10 is divided into a plurality of branches corresponding to the number of the ultrasonic vibrators 20 and the first hose 71 branched into a plurality of branches, and the first hose 71 divided to into a plurality of branches are provided adjacent to one side of the plurality of ultrasonic transducers 20.

Accordingly, when the water pump 73 is operated, the liquid stored in the liquid reservoir 60 is supplied to the interior of the housing 10.

Of course, when the liquid inside the housing 10 is recovered, the liquid in the housing 10 can be recovered to the liquid reservoir 60 through the water pump 73.

A liquid level detecting means (not shown) for detecting the liquid level in the housing 10 is installed in the housing 10.

The water level sensing means is formed by installing a water level sensor inside the housing 10. Of course, it is possible to use various well-known apparatuses for detecting the water level as well as the water level sensor as the water level detecting means.

In addition, the liquid supply device 70 is selectively operated according to the liquid level sensed by the liquid level sensing means.

In other words, the liquid level in the housing 10 must be maintained at an optimum level to increase the amount of fine liquid particles to be generated. According to the level information provided from the liquid level detecting means, so that the optimum liquid level is maintained.

On the other hand, a controller (not shown) for operating the super-particle spraying apparatus 1 is provided on the outer surface of the housing 10 to turn on and off the power, thereby controlling the apparatus 70 and the like.

Hereinafter, the operation of the super-particle spraying apparatus 1 according to the present invention will be described.

First, the liquid stored in the liquid reservoir 60 is supplied to the inside of the housing 10 when the liquid supply device 70 is operated in a state where the liquid is supplied to the liquid reservoir 60.

At this time, when the liquid supplied to the inside of the housing 10 reaches an appropriate water level, the liquid supply device 70 is stopped by the signal of the water level sensing means.

Thereafter, when the ultrasonic vibrator 20 and the blower 30 are operated, The ultrasonic vibrator 20 vibrates to generate fine liquid particles from the surface of the liquid in the housing 10. At the same time, the air blown from the blower 30 flows into the air inlet 15 of the housing 10, and then guided by the guide plate 50 to flow toward the upper side of the housing 10 to increase the flow velocity.

At this time, a negative pressure (venturi effect) is generated in a lower region of the inner plate 40 due to a rapid air flow velocity above the guide plate 50, so that the circulation passage 17 around the inner plate 40, so that only the fine liquid particles generated in the lower region of the inner plate 40 are sucked up.

After then, the fine liquid particles sucked up from the lower region of the inner plate 40 to the upper region are sprayed to the outside through the spray port 16 and the discharge duct 80 on the upper side of the housing 10 to be rapidly diffused.

The invention claimed is:

1. An apparatus for superparticle spraying comprising:

a housing forming an air inlet at one side of the housing and accommodating a liquid therein;

an ultrasonic vibrator being installed at the housing and generating fine liquid particles by vibrating the liquid;

a blower carrying the air inside the housing through the air inlet;

an inner plate being spaced apart from upper of the ultrasonic vibrator by a predetermined distance inside of the housing, and forming a circulation passage to circulate the fine liquid particles by using the flow rate of the air which is blown into the inside of the housing through the blower, the circulation passage being defined between the inner plate and the housing;

a spray nozzle being formed on the housing, and a guide plate being disposed between the air inlet and the inner plate and guiding air introduced from the air inlet to an upper area of the circulation passage, wherein the guide plate generates a venturi effect for the circulation passage between the inner plate and the guide plate by using a velocity of an air stream blown into the housing by the blower, wherein the fine liquid particles generated by the ultrasonic vibrator under the inner plate are pulled up by the venturi effect and circulate along the circulation passage, wherein at least a portion of the fine liquid particles is sprayed outside the housing through the spray nozzle.

2. The apparatus of claim 1, wherein the air inlet is formed on one side of the housing facing one longitudinal end of the inner plate, and the guide plate are installed at an angle between the air inlet and the inner plate.

3. The apparatus of claim 2, wherein the lower end of the guide plate is connected to the lower end of the air inlet and the upper end of the guide plate is disposed at a predetermined distance upward from the one longitudinal end of the inner plate.

4. The apparatus of claim 1, wherein a plurality of ultrasonic transducers are provided on a bottom plate inside the housing at a predetermined distance from each other, and the inner plate is disposed parallel to the bottom plate inside the housing, and a length of the inner plate is greater than the length connected to the centers of the two ultrasonic transducers at both ends of the plurality of the ultrasonic transducers.

5. The apparatus of claim 1, further comprising:

a blocking plate preventing diffusion of water droplets from the liquid as well as controlling the cross-sectional area of the circulation passage.

6. The apparatus of claim 1, wherein the spray nozzle is formed on the upper side of the housing opposite to the air inlet, and a discharge duct having a predetermined height is installed on the spray nozzle.

7. The apparatus of claim 6, wherein an inclined surface portion inclined downward from an edge is formed on an upper end of the discharge duct.

8. The apparatus of claim 6, wherein a cross-sectional area of the air inlet and a cross-sectional area of the spray nozzle are identical.

9. The apparatus of claim 1, wherein a liquid reservoir for storing liquid to be supplied to the inside of the housing is provided at one side of the housing, and a liquid supply device for supplying the liquid to the inside of the housing is provided.

10. The apparatus of claim 9, wherein the liquid supply device comprises a first hose connected to the inside of the housing, and a second hose connected to the inside of the liquid reservoir, and a water pump connected to the first hose and the second hose.

11. The apparatus of claim 9, wherein the liquid supply device is selectively operated according to the liquid level inside the housing.

* * * * *